US007229369B2

(12) United States Patent
Schwenger

(10) Patent No.: US 7,229,369 B2
(45) Date of Patent: Jun. 12, 2007

(54) BALL SPORT RACQUET ESPECIALLY TENNIS RACQUET

(75) Inventor: Ralf Schwenger, Straubing (DE)

(73) Assignee: Volkl Tennis GmbH, Straubing (DE)

( * ) Notice: Subject to any disclaimer, the term of this patent is extended or adjusted under 35 U.S.C. 154(b) by 0 days.

(21) Appl. No.: 11/132,430

(22) Filed: May 19, 2005

(65) Prior Publication Data

US 2005/0277496 A1 Dec. 15, 2005

(30) Foreign Application Priority Data

May 19, 2004 (DE) ..... 10 2004 025 346

(51) Int. Cl.
*A63B 49/02* (2006.01)

(52) U.S. Cl. ..... 473/546; 473/521

(58) Field of Classification Search ..... 473/524, 473/546, 520–522

See application file for complete search history.

(56) References Cited

U.S. PATENT DOCUMENTS 1,476,906 A * 12/1923 Santa Maria ..... 473/534
1,912,942 A * 6/1933 Kleinman ..... 473/534
2,456,023 A * 12/1948 Rosenbalm ..... 473/541
3,990,700 A * 11/1976 Robinson ..... 473/534
4,247,103 A * 1/1981 Garver ..... 473/545
4,311,308 A * 1/1982 Volkl et al. ..... 473/546
5,133,552 A * 7/1992 Feeney et al. ..... 473/537
5,282,617 A * 2/1994 Hong ..... 473/546
2005/0277496 A1* 12/2005 Schwenger ..... 473/546

* cited by examiner

*Primary Examiner*—Raleigh W. Chiu
(74) *Attorney, Agent, or Firm*—Hoffman, Wasson & Gitler, PC

(57) ABSTRACT

In a ball sport racquet, for example, a tennis racquet, made up of a main or racquet head frame, a throat with a throat bridge and side bridges diverging to the throat bridge and extending into a shaft, and strings fastened on the main frame and on the throat bridge, the throat bridge can move restrictedly relative to the main frame at least in one axis direction perpendicular to the plane of the strings and/or can rotate on the racquet frame on an axis extending in the direction of a longitudinal axis of the racquet.

11 Claims, 2 Drawing Sheets

BALL SPORT RACQUET ESPECIALLY TENNIS RACQUET

BACKGROUND OF THE INVENTION

The invention relates to a ball game or ball sport racquet. Ball sport or ball game racquets, in particular tennis racquets, are known in a wide variety of designs.

It is an object of the present invention is to provide for a ball game or ball sport racquet that features improved vibration or playing characteristics.

SUMMARY OF THE INVENTION

An object is achieved by a ball game or ball sport racquet, e.g. tennis racquet, having a main or racquet head frame (3), a throat (4, 4*a*) with a throat bridge (7) and side bridges (6) diverging to the throat bridge and extending into a shaft (5), and strings (8) fastened on the main frame (3) and on the throat bridge (7), wherein the throat bridge (7) can move restrictedly relative to the main frame (3) at least in one axis direction perpendicular to the plane of the strings (8) and/or can rotate on the racquet frame (2, 2*a*) on an axis extending in the direction of a longitudinal axis (L) of the racquet.

BRIEF DESCRIPTION OF THE DRAWINGS

Representative embodiments of the invention are described below with reference to the drawings, in which.

DETAILED DESCRIPTION OF THE INVENTION

Figure 1:
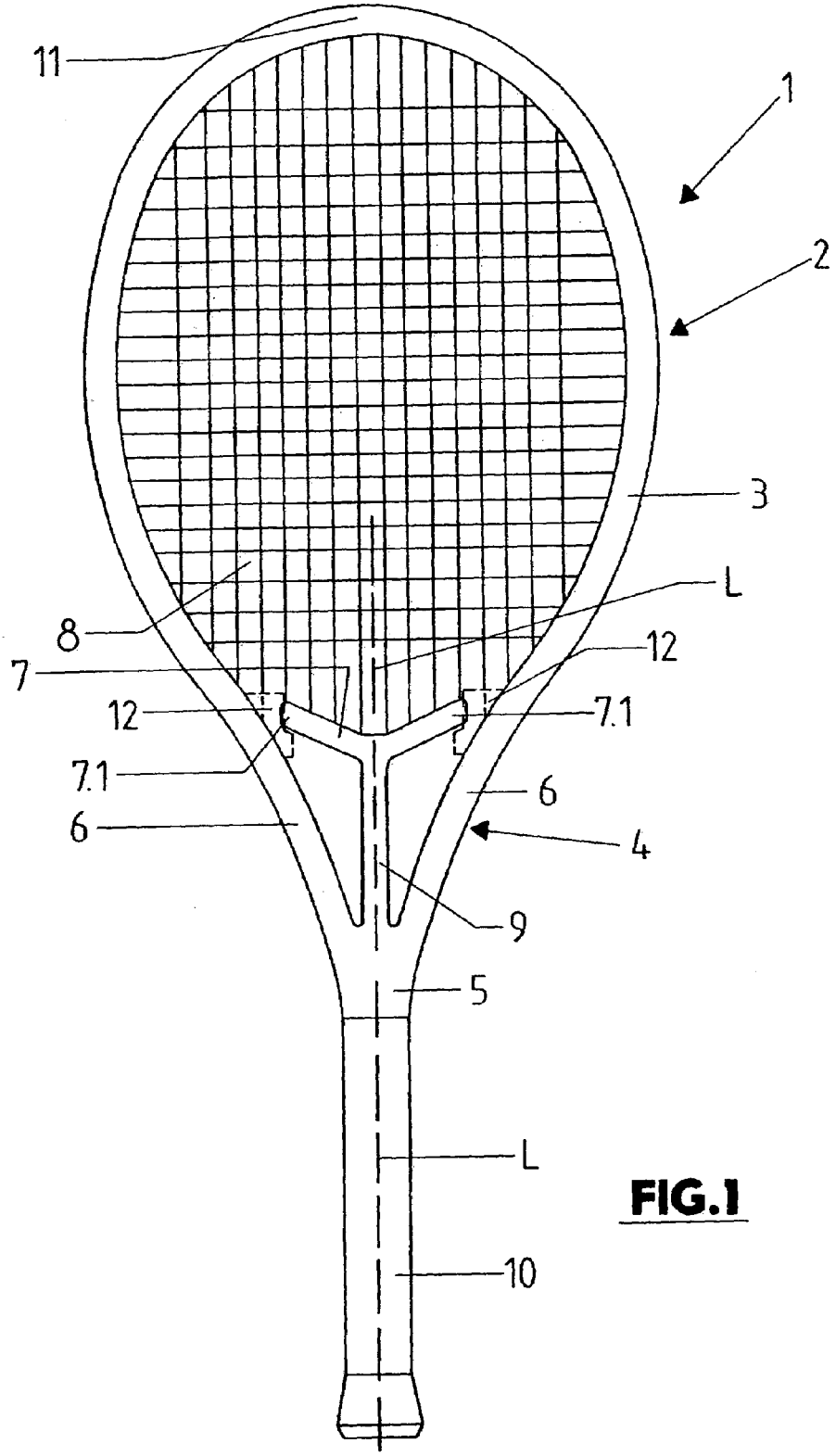
FIG. 1 shows a simplified representation in top view of a ball sport or ball game racquet in the form of a tennis racquet.

The ball sport racquet, such as a tennis racquet, depicted in FIG. 1 and generally designated 1 includes a racquet frame 2, which is made up of a main or head frame 3, two side bridges 6 connected to the main frame 3, forming the throat or racquet heart portion 4 and extending into the shaft 5, and a heart or throat bridge 7. The latter, together with the main frame 3 limits the hitting area or stringed surface of the racquet formed by the stringing 8, i.e. the lengths of string forming the stringing 8 are held in the usual manner on the racquet head or main frame 3 and on the throat bridge 7.

A characteristic feature of the ball sport racquet 1 rests in the fact that the throat bridge 7 is not directly connected with the main frame 3 nor does it directly contact the main frame 3, but rather is fastened to the end of an auxiliary bridge 9 facing the main frame 3 and the stringing 8 provided within the throat 4 on the same axis as the longitudinal axis L of the racquet (the longitudinal axis of the auxiliary bridge 9 is within the axis L of the racquet) and which extends with its end furthest away from the throat bridge 7 into the shaft 5, in the depicted embodiment at the point where the two side bridges 6 diverging toward the stringing 8 or the racquet head extend into the shaft 5. The two ends 7.1 of the throat bridge are moveable relative to the main frame. The auxiliary bridge 9 being formed by only one strap like bar or leg and extends for the shaft onto the throat bridge 7 forming two arms nearly radial extending from the auxiliary bridge 9. The ball sport racquet 1 and its frame 2 are symmetrical to the longitudinal axis L, which is on the same axis as the shaft 5.

The racquet frame 2 is designed as one piece with the aforesaid frame elements, as an outwardly closed hollow profile. In the depicted embodiment, the shaft 5 is designed for example so that its hollow or cross-section profile consists of three closed profile sections or hollow chambers, which connect with each other in one axis direction parallel to the plane of the stringing 8 and the two outer chambers of which are formed by one hollow profile corresponding to the two side bridges 6 and the chamber in between is formed by one hollow chamber corresponding to the auxiliary bridge 9. The usual grip 10 is provided on the shaft 5.

As FIG. 1 further shows, the two ends of the throat bridge 7, which (ends) are located on an imaginary connecting line parallel to the plane of the stringing 8 and perpendicular to the longitudinal axis L, are both adjacent to the interior of the main frame 3.

Due to the described design of the racquet frame 2, the hitting area formed by the strings 8 exhibits different elasticity, e.g. in the area of the head 11 furthest away from the throat bridge 7, the elasticity of the hitting area formed by the strings 8 is determined by the inherent elasticity of the strings or stringing 8 and especially by the flexural and torsional strength of the main frame 3 in the area of the racquet head 11. In the area of the bridge 7, the elasticity of the hitting area is determined not so much by the flexural and torsional strength of the main frame 3 as by the flexural and torsional strength of the throat bridge 7 and in particular of the auxiliary bridge 9. The elasticity of the hitting area there can be affected as desired by the length, profile and material used for the auxiliary bridge 9. The described design can be used to improve the vibration and/or playing characteristics of the ball sport racquet 1. At this embodiment, the two ends of the throat bridge 7 are connected to the main frame 3 by means of a permanently elastic material 12, e.g. shock-absorbing material.

Figure 2:
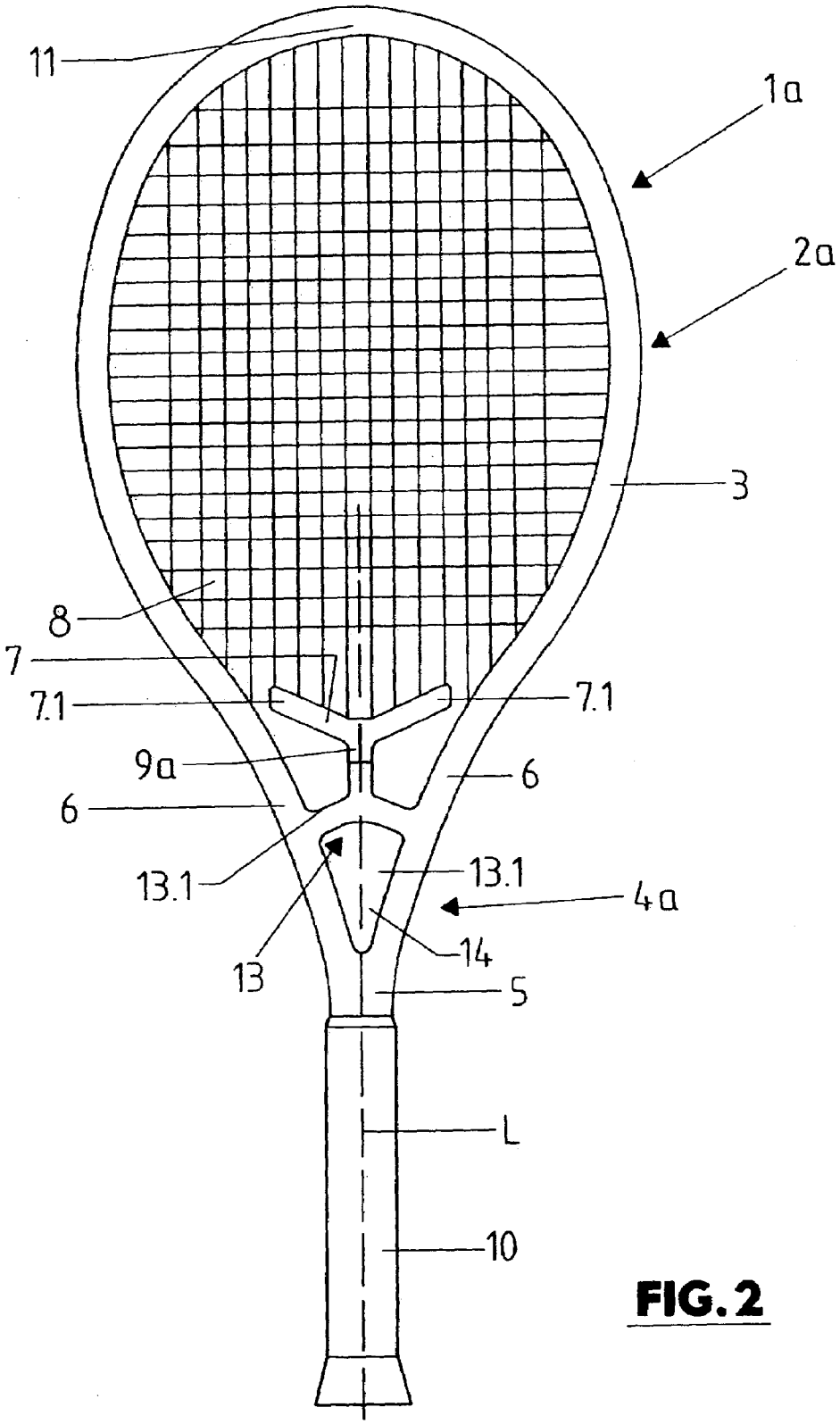
FIG. 2 shows a representation similar to FIG. 1 of a further embodiment of the invention.

FIG. 2 shows, in a depiction similar to FIG. 1, a further possible embodiment of a ball sport racquet 1*a*, which differs from the ball sport racquet 1 essentially only in that for the racquet frame 2*a* forming this racquet, the auxiliary bridge 9*a*, on which the throat bridge 7 is fastened, is shorter and on its end furthest away from the throat bridge 7 extends into a bridge connecting the side bridges 6 of the throat 4*a* and which in the depicted embodiment is formed by two essentially straight bridge sections 13.1, which form an angle larger than 90° with their longitudinal extension, i.e. in the depicted embodiment an angle of approximately 120°, which opens toward the shaft 5, so that the longitudinal extensions of the two bridge sections 13.1 and the auxiliary bridge 9*a* form a star-shaped structure with elements offset at an angle of 120°.

The bridge 13, which is located at a distance from the area where the side bridges 6 extend into the shaft 5, encloses together with the side bridges an opening 14. Furthermore, the throat bridge 7, the auxiliary bridge 9*a*, the bridge 13 with its bridge sections 13.1 in this embodiment are formed as one piece with the remaining racquet frame 2*a*, which in this embodiment is again symmetrical relative to the longitudinal axis L.

The invention was described above based on exemplary embodiments. It goes without saying that numerous modifications and alterations are possible without abandoning the underlying inventive idea upon which the invention is based.

For example, it is possible to provide, instead of one single auxiliary bridge, a plurality of auxiliary bridges, e.g. two auxiliary bridges, which then extend along or parallel to a bridge 6.

REFERENCE MARKS

1, 1*a* ball sport racquet (tennis racquet)
2, 2*a* racquet frame
3 head or main frame
4, 4*a* throat or heart portion
5 shaft
6 side bridge
7 throat bridge
8 strings
9, 9*a* auxiliary bridge
10 grip
11 racquet head
12 flexible and/or shock-absorbing material
13 additional bridge
13.1 bridge section
14 opening
L longitudinal axis

What is claimed is:

1. A ball game, or ball sport racquet, comprising:
a main or racquet head frame;
a throat with a throat bridge and side bridges diverging to the throat bridge and extending into a shaft;
strings fastened on the main frame and on the throat bridge, wherein the throat bridge can move restrictedly relative to the main frame
wherein the throat bridge is held on one end of at least one auxiliary bridge which extends in a direction of a longitudinal axis of the shaft,
the throat bridge forms two arms which extend radial or nearly radial from the at least one auxiliary bridge and comprises two ends, each of which is adjacent to an inner surface of the main frame and at a distance from the main frame
wherein the ends are connected with the main frame by means of an elastic and/or shock-absorbing material section.

2. The ball sport racquet according to claim 1, wherein the at least one auxiliary bridge is a bar like or strap like element, which extends from the shaft or from an additional bridge in the direction of the main frame or of the stringing.

3. The ball sport racquet according to claim 1, wherein the at least one auxiliary bridge is manufactured as one piece with the remaining racquet frame.

4. The ball sport racquet according to claim 1, wherein the racquet frame is an outwardly closed hollow frame.

5. The ball sport racquet according to claim 4, wherein the throat bridge has an outwardly closed hollow profile.

6. The ball sport racquet according to claim 1, wherein the at least one auxiliary bridge has an outwardly closed hollow profile.

7. The ball sport racquet according to claim 1, wherein the racquet frame is symmetrical to a longitudinal axis (L) of the racquet.

8. The ball sport racquet according to claim 1, wherein the ends of the throat bridge are on an imaginary connecting line perpendicular to the longitudinal extension of the racquet's longitudinal axis (L).

9. The ball sport racquet according to claim 1, wherein the ends of the throat bridge are on a connecting line parallel to the plane of the strings.

10. The ball sport racquet according to claim 1, wherein the side bridges of the throat and the at least one auxiliary bridge are joined to form a profile of the shaft comprising at least three chambers.

11. The ball sport racquet according to claim 1, wherein the at least one auxiliary bridge extends with ist end furthest away from the throat bridge into one additional bridge connecting or bridging the side bridges of the throat.

* * * * *